United States Patent [19]

Noguchi et al.

[11] 4,293,940

[45] Oct. 6, 1981

[54] TIME SOUND GENERATING DEVICE

[75] Inventors: Satoshi Noguchi, Fujisawa; Takaya Kitao, Kamakura, both of Japan

[73] Assignee: Matsushita Electric Industrial Co., Ltd., Osaka, Japan

[21] Appl. No.: 912,535

[22] Filed: Jun. 5, 1978

[30] Foreign Application Priority Data

Jun. 16, 1977 [JP] Japan ..... 52-79568[U]
Aug. 25, 1977 [JP] Japan ..... 52-114362[U]
Aug. 26, 1977 [JP] Japan ..... 52-115041[U]

[51] Int. Cl.[3] ..... G04B 21/02; G04C 23/00; G04B 23/02; G04C 21/16

[52] U.S. Cl. ..... 368/75; 368/244; 368/245

[58] Field of Search ..... 58/18, 19 R, 38 R, 19 A, 58/19 B, 16 R; 340/715, 794; 368/245, 244, 272, 75

[56] References Cited

U.S. PATENT DOCUMENTS 3,728,855 4/1973 Preiser ..... 58/38
4,166,358 9/1979 Tremblay et al. ..... 368/245

FOREIGN PATENT DOCUMENTS 50-104064 8/1975 Japan .

*Primary Examiner*—J. V. Truhe
*Assistant Examiner*—John B. Conklin
*Attorney, Agent, or Firm*—Stevens, Davis, Miller & Mosher

[57] ABSTRACT

A time sound generating device which generates a time announcement sound by detecting a change of time from a portion of a display element driving signal supplied to a time display element of a digital electronic clock and by driving an audio sound signal source by the detected time signal.

8 Claims, 11 Drawing Figures

FIG. 1
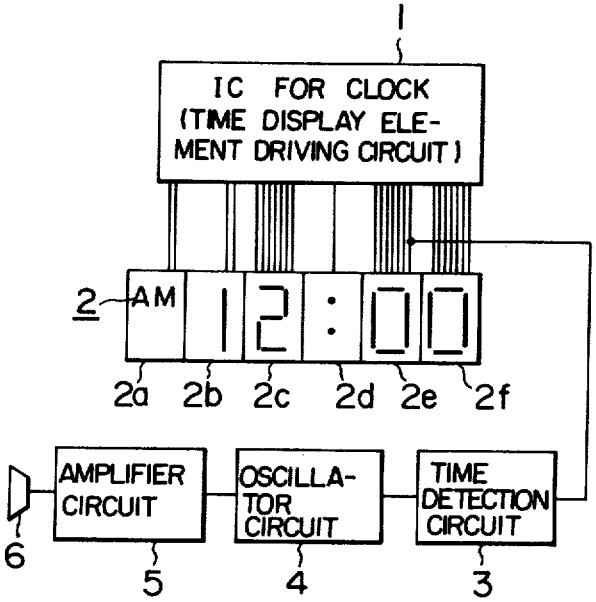
FIG. 2A
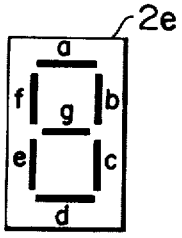
DISPLAY PART OF 10-MINUTE LEVEL
FIG. 2B
| DISPLAY NUMBER | 1 | 2 | 3 | 4 | 5 | 0 |
|---|---|---|---|---|---|---|
| OUTPUT OF SEGMENT "b" | H | H | H | H | L | H |
OUTPUT OF THE SEGMENTS FOR DISPLAY OF 10-MINUTE LEVEL FIG. 4
| DISPLAY NUMBER | 1 | 2 | 3 | 4 | 5 | 6 | 7 | 8 | 9 | 0 |
|---|---|---|---|---|---|---|---|---|---|---|
| SEGMENT "a" | L | H | H | L | H | H | H | H | H | H |
| SEGMENT "e" | L | H | L | L | L | H | L | H | L | H |
OUTPUT OF THE SEGMENT OF THE DISPLAY FOR 1-HOUR LEVEL
FIG. 5
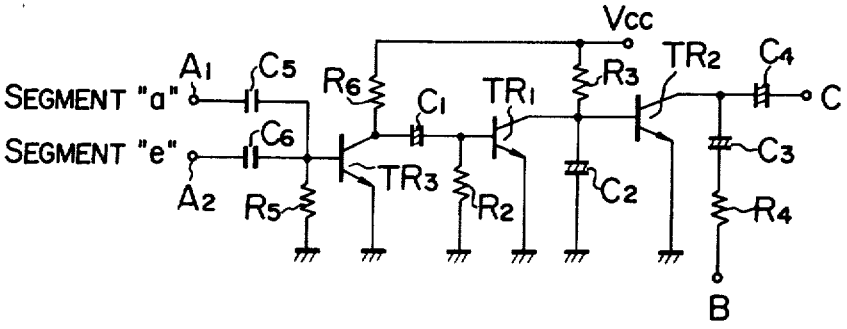
FIG. 6
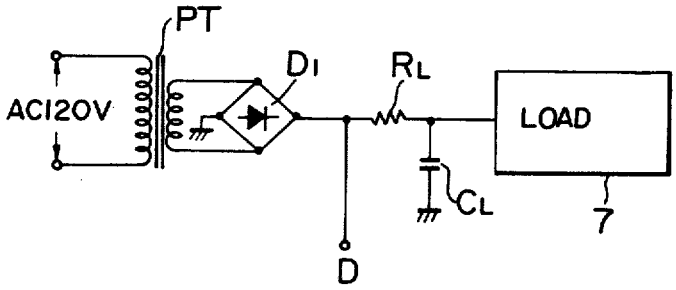

TIME SOUND GENERATING DEVICE

This invention relates to a time sound generating device of a digital clock which can generate a time announcement sound through a simple circuit construction.

In almost all digital clocks, time is displayed by LED's, fluorescence display tubes, etc. Generation of such a time sound requires special IC's and special circuits, which are very expensive.

According to this invention, a time sound can be generated simply by using conventional inexpensive clock IC's.

Preferred embodiments of this invention will be explained hereinafter with reference to the accômpanying drawings, in which, FIG. 1 is a block diagram of a time sound generating device according to one embodiment of this invention;

FIG. 2A shows a construction of a 10-minute display digit in a time display part, while FIG. 2B is a table showing potential variation of the display of 10-minute level;

FIG. 4 is a table showing potential variation of segments "a" and "e" of a 1-hour display digit;

FIG. 5 shows a schematic diagram of another time detection circuit;

FIG. 6 shows a schematic diagram of a time sound generator;

Figure 3:
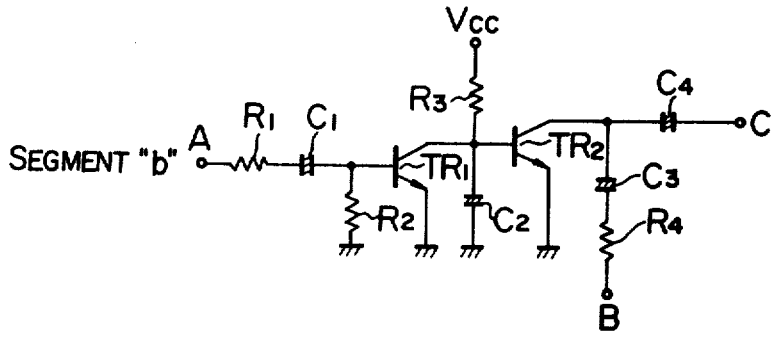
FIG. 3 shows a schematic diagram of a time detection circuit.

In FIG. 1 showing the construction of a device of this invention, 1 denotes an IC for a clock (time display element driving circuit) which, with an input of a commercial power supply of a frequency of 50 or 60 Hz, counts the frequency and generates display outputs of minutes and hours. Numeral 2 denotes a time display element such as a LED, a fluorescent display tube, or a liquid crystal. FIG. 1 shows the situation where the time display element 2 is composed of six figures, i.e. an AM/PM display portion *2a*, a time display portion for a 10-hour digit *2b* which displays a time announcement number in the order of a 10-hour period, a time display portion for a 1-hour digit *2c* which displays a time announcement number in the order of a 1-hour period, a colon for the seconds display *2d*, a time display for a 10-minute digit *2e*, and a time display portion for a 1-minute digit *2f*. Each display portion *2a* to *2f* has input pins (not shown) which correspond one to one to its segments (maximum 7 segments). Each input pin is connected with each output pin (not shown) of the clock IC 1. Numeral 3 denotes a time detection circuit which detects timing for generating a time sound such as at 1 hour 00 minute, 2 hour 00 minute, etc. Numeral 4 denotes an oscillator for producing a time sound. Numeral 5 denotes an amplifier circuit which amplifies such a time sound signal to emit the time sound from a loudspeaker 6.

When the digital clock is used in combination with a television receiver and a radio receiver etc., an amplifier circuit and a loudspeaker in the receiver can be used in place of the amplifier 5 and the speaker 6 shown in FIG. 1.

FIG. 2A shows a construction example of the display portion of the 10-minute digit *2e* in FIG. 1. FIG. 2B shows the variations of a segment "b" of the display portion of the 10-minute digit *2e*. Timing for the production of a time announcement sound is obtained by detecting a rise of the output signal applied to the segment "b". That is the time, P hour 00 minute is detected in the following manner. Since Q-hour 00 minute follows P hour 59 minute, variation of "5" to "0" in the display for the 10-minute digit *2e* should be detected. The segment "b" is at a high level when the numerals "1" to "4" are displayed, at a low level when the numeral "5" is displayed and changes to a high level when the numeral "0" is displayed. Therefore, the variation from a low to a high level of the segment "b" can be detected for a change in the hour display.

In a time detection circuit 3 shown in FIG. 3, the output variation of the segment "b" is detected by a differentiation circuit comprising a resistor $R_1$, a resistor of high resistance $R_2$ and a condenser $C_1$. In this figure, A denotes an input terminal connected to the segment "b". $TR_1$ denotes a transistor. The differentiaion circuit is inserted between the base of the transistor $TR_1$ and the input terminal A. The collector of the transistor $TR_1$ is connected to a power supply terminal through a resistor and to a reference voltage terminal through a condenser $C_2$. $TR_2$ denotes a transistor whose base is connected with the collector of the transistor $TR_1$. The collector of the transistor $TR_2$ is connected to an ouput terminal C through a condenser $C_4$ and to an input terminal B through a series circuit of a condenser $C_3$ and a resistor $R_4$. The input terminal B is connected with the output terminal of an oscillator 4. The output terminal C is connected to an amplifier circuit 5.

In FIG. 3, while the input terminal A is at low level (i.e. a display numeral "5" is being displayed) the, charge stored in the condenser $C_1$ is substantially zero. When the input terminal A becomes a high level, the condenser $C_1$ is charged with a time constant determined by the resistor $R_1$ and the condenser $C_1$. If the value of the resistor $R_1$ is chosen small, the condenser $C_1$ is charged very quickly. The transistor $TR_1$ turns on substantially at the same time the input terminal A becomes a high level. The transistor $TR_1$ remains on for the duration of a positive differentiation pulse applied in response to the potential change of the input terminal A. In the subsequent period of about 50 minutes the input terminal A is maintained at high level and the transistor $TR_1$ is turned off. When the input terminal A changes from a high to a low level, the base potential of transistor $TR_1$ changes in a minus direction but does not influence the switching state of transistor $TR_1$. As described above, detection of P hour 00 minute condition becomes possible at the collector of the transistor $TR_1$.

The transistor $TR_2$ forms an analog switch circuit which has a signal input at a terminal B from the oscillator 4 and produces an output signal on a terminal C. When the transistor $TR_2$ is on, the input signal at the terminal B is divided by the resistor $R_4$ and a low impedance of the transistor $TR_2$ and attenuated. Almost no signal appears at the terminal C. When the transistor $TR_2$ is off, the input signal at the terminal B appears substantially intact on the terminal C.

Therefore, since the condenser $C_2$ is charged through the resistor $R_3$ by a positive voltage supply Vcc when the transistor $TR_1$ is off, the transistor $TR_2$ turns on and no signal appears on the terminal C. However, as soon as the input terminal A changes from low to high level, or the display number of the display part for 10-minute digit 2e changes from "5" to "0", the transistor $TR_1$ turns on and the charge in the condenser $C_2$ is discharged instantaneously through the transistor $TR_1$. At the same time, the transistor $TR_2$ turns off and a signal with nearly the same amplitude as at B appears at the terminal C. After a time determined by the condenser $C_1$ and the resistor of high resistance $R_2$, the transistor $TR_1$ turns off. The condenser $C_2$ begins to be charged through the resistor $R_3$. In accordance with the rate of charging, the transistor $TR_2$ changes slowly to the on state and the output voltage at the terminal C decreases towards zero giving a gradually diminishing tone. If such a time announcement signal is amplified by the amplifier 5 to drive the loudspeaker 6, a soft sound having an echo is obtained.

FIG. 4 shows the potential variations of segments "a" and "e" in the display portion for 1-hour digit 2C which are used for detection of time. FIG. 5 shows a schematic diagram of the time detection circuit. Like reference numerals are used to denote like elements having the same function. So, a detailed explanation of them is omitted.

In FIG. 5, input terminals $A_1$ and $A_2$ connected with the segments "a" and "e" respectively are provided. One end of differentiating condensers $C_5$ and $C_6$ are connected commonly. The connection point is connected to a reference voltage through a bias resistor $R_5$ and to the base of a transistor $TR_3$, the collector of which is connected to a terminal of a voltage supply through a collector resistor $R_6$ and connected to the base of the transistor $TR_1$ through the condenser $C_1$.

Change from a high to a low level or from a low to a high level of the segments "a" and "e" in FIG. 5 is detected by the differentiating condensers $C_5$ and $C_6$ and applied to the base of the transistor $TR_1$ after being amplified and shaped by the transistor $TR_3$. In this case, the two segments should be in such a relation that for a change from the display number "1" to "2", 2" to "3", etc. either segment changes its level. The operation thereafter is the same as that of FIG. 3, but the values of condensers $C_5$ and $C_6$ are different from those of FIG. 3. They are selected to give both positive and negative pulses through differentiation when the waveforms on the input terminals $A_1$ and $A_2$ change.

FIG. 6 shows the simplest example of the electrical generation of the time sound. In this example, the commercial power supply voltage is reduced by a power transformer PT and full-wave rectified by a bridge rectification circuit $D_1$. A sound with a frequency twice the commercial frequency is taken out from a terminal D and applied to the input terminal B of FIG. 3 or FIG. 5. In FIG. 6, $R_L$ and $C_L$ denote a resistor and a condenser constituting a filter circuit respectively. A d.c. voltage is supplied to a load 7 (a clock IC, a television receiver or a radio receiver).

Figure 7:
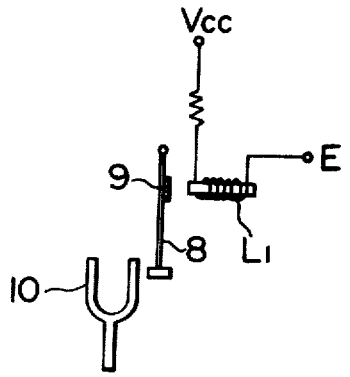
FIG. 7 shows a schematic diagram of another time sound generator.

FIG. 7 shows a mechanical time sound generator comprising an electromagnet $L_1$, a rotatably supported hammer 8, an iron piece 9 fixed to the hammer, and vibration piece 10 such as a tuning fork or a plurality of bars and pipes. In FIG. 7, the collector of transistor $TR_2$ of FIG. 3 or FIG. 5 is connected with a terminal E so that, while the transistor $TR_2$ is on, the electromagnet $L_1$ is driven to pull the iron piece 9 and separate it from the vibration piece 10. When the transistor $TR_2$ becomes off, the vibration piece 10 is struck by the hammer 8.

Figure 8:
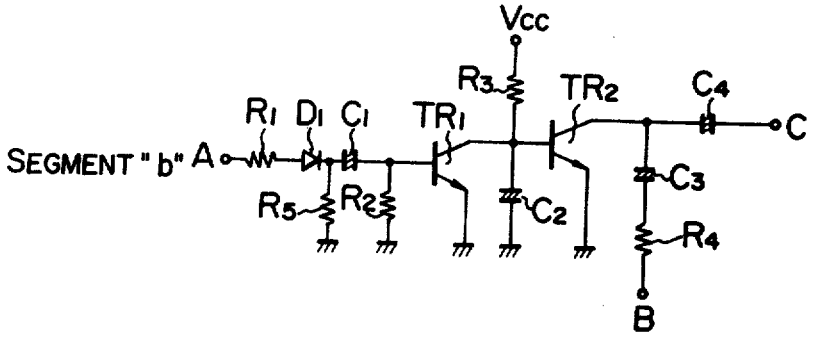
FIGS. 8 to 10 shows schematic diagrams of other time detection circuit schematic.

FIG. 8 shows another example of a time detection circuit 3. Like reference numerals are used to denote like elements having the same function as that of the elements of FIG. 3.

In FIG. 8, in addition to the circuit of FIG. 3, a diode $D_1$ is inserted between the resistor $R_1$ and the condenser $C_1$ with the cathode on the side of condenser $C_1$, and a resistor $R_5$ is inserted between a connection point of the diode $D_1$ and the condenser $C_1$ and a reference voltage.

Next, consider how a time adjustment is performed in the clock IC 1 as shown in FIG. 1. Usually, time adjustment is accomplished by sequentially increasing the display time, i.e. P hour 00 minute, P hour 01 minute, P hour 02 minute, . . . , Q hour 00 minute. As a result, the time sound generating circuit using the time detection circuit shown in FIG. 3 is inconvenient because, at every X hour 00 minute, a time sound is generated. In a clock IC capable of displaying X minute ΔΔ second by the same display segments by utilizing a switch (not shown), a similar inconvenience arises at every X minute 00 seconds.

The circuit shown in FIG. 8 solves this problem in a simple way. Explanation of the circuit will be made next.

In the FIG. 8 circuit, the fact that the condenser $C_1$ discharges only when the input terminal A is at low level, or when the display number is "5", is utilized. By insertion of the diode $D_1$ which is cut off when the input terminal A is at low level, the condenser discharges through the resistors $R_2$ and $R_5$. Thus, if the resistance of the resistor $R_5$ is made high enough to keep the discharge time of the condenser $C_1$ longer than 1 minute, the time detection circuit does not operate unless the display number keeps the state "5" for more than 1 minute. This means that, when the time display is varied for the purpose of adjusting the time, quick feed from P hour 50 minute to Q hour 00 minute may be done within 1 minute and that quick feed from P hour 00 minute to Q hour 00 minute may be done within 6 minutes. Practically, it is unreal to spend 6 minutes for a 1 hour time adjustment. Usually, a 1 hour quick feed is done by a fast and rough time adjustment taking a time period of 1 second or the like, while a 1 minute quick feed is done by a fine time adjustment also taking a time period of 1 second or the like. Therefore, for 1 minute quick feed taking one second, the period of display number "5" is only 10 seconds so that the problem of unnecessarily generating the sound at each time adjustment can be completely avoided.

In FIG. 8, when the input terminal is at high level the diode $D_1$ is conducting. Since charging of condenser $C_1$ is done rapidly, timing for generating such a time sound is not influenced.

A similar explanation holds for the inconvenience arising for a display of a second. The period of display number "5" occurs only for 10 seconds from P minute 50 second to Q minute 00 second so that the inconvenience of generating the unnecessary time sound can be completely avoided.

Although in the above explanation the discharge time of condenser $C_1$ is made larger than 1 minute by increasing the value of the resistor $R_5$, it is needless to say that the same effect can be obtained practically by a discharging time of the order of 10 seconds. The discharge time of this order can be simply obtained by usual resistors and condensers without using special elements.

The circuit of FIG. 8 has the additional advantage of preventing a negative pulse from appearing at the base of the transistor $TR_1$ when input terminal A changes from a high to a low level. Without the diode $D_1$, the negative pulse caused by a level change at terminal A could destroy the emitter junction of transistor $TR_1$. This problem can be completely avoided by the FIG. 8 circuit.

Figure 9:
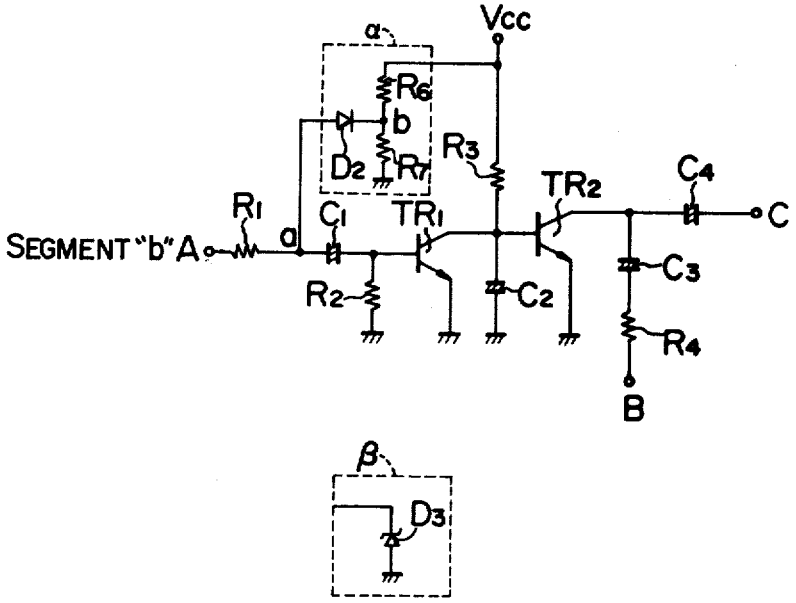

FIG. 9 shows another embodiment of the time detection circuit 3. This embodiment prevents an erroneous operation of the time detection circuit which may happen when the brightness of the time display element is adjustable.

If the brightness of the display element is required to be adjustable, usual methods currently employed are to vary the high level voltage of each output pin of the clock IC 1 by insertion of a variable resistor for brightness adjustment or to switch a plurality of resistors with different resistances in circuit with a switch. However, if the high level voltage is varied by a variable resistor, the voltage at the terminal A fluctuates around the high level in addition to changing from a low to a high level. This may cause an erroneous operation of the time sound generating circuit.

Now, if we assume that the high level of the terminal A is varied between $H_L$ and $H_H$ by a brightness adjusting variable resistor with a relation $H_H-H_L \geqq H-L$, then it is considered that a time sound generating circuit with the time detection circuit of FIG. 3 may generate a time sound due to a rapid change of the variable resistor. In the FIG. 9 embodiment, a relationship $H_H-H_L << H-L$ is obtained by a diode $D_2$ and resistors $R_6$ and $R_7$.

According to this embodiment, in addition to the circuit of FIG. 3, a series circuit of a resistor $R_6$ and a resistor $R_7$ is inserted between a voltage supply terminal and a reference voltage, and a diode $D_2$ is inserted between a connection point of the resistor $R_1$ and the condenser $C_1$ and a connection point of the resistors $R_6$ $R_7$.

If the values of resistors $R_6$ and $R_7$ are selected such that the potential $V_b$ at the point b satisfies $V_b \leqq H_L$, the potential $V_a$ at the point a is fixed $V_a=V_b+V_{D2}$ when the input terminal A is at a high level (where $V_{D2}$ denotes a voltage drop in the forward direction of diode $D_2$) so that a variation between $H_H$ and $H_L$ does not appear at the point a. When the input terminal A is at a low level, the diode $D_2$ is cut off and the circuit condition is the same as that of FIG. 3. Thus the charging of the condenser $C_1$ is rapidly done as in FIG. 3 when the terminal A switches to a high level.

Therefore, in the circuit shown in FIG. 9, even if the terminal A varies from L (low level), through $H_L$ to $H_H$, the potential at the point a varies only from L to $V_b+V_{D2}$. Thus, the inconvenience of generating a time sound which could arise by a rapid change of the brightness adjusting variable resistor at each brightness adjustment can be avoided.

If the value of the resistor $R_7$ is large, the potential at the point a varies a little. This problem can be solved by using a Zener diode $D_3$ as shown in a circuit $\alpha$ instead of the circuit $\alpha$. In this case, it is necessary that $V_b=V_z$ ($V_z$ is the Zener voltage of the Zener diode $D_3$).

Figure 10:
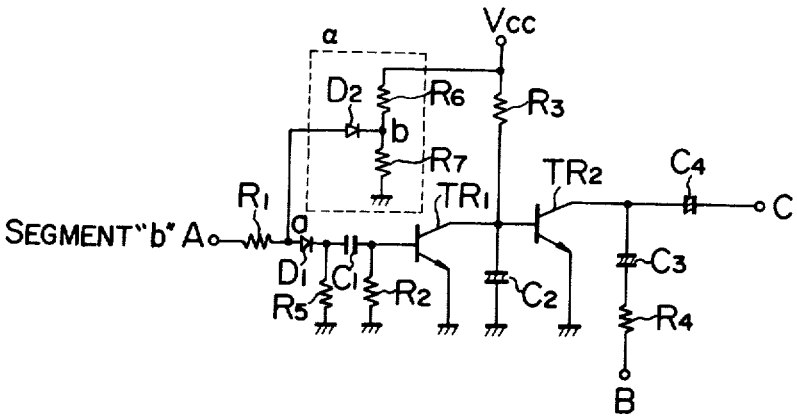

FIG. 10 shows a further embodiment of the time detection circuit 3. This embodiment combines the circuit constructions of FIGS. 8 and 9. The anode of the diode $D_2$ is connected with the anode of the diode $D_1$. FIG. 10 obtains the merits of both FIGS. 8 and 9.

Although the foregoing embodiments are adapted to produce the time announcement sound when the second switching transistor is maintained off, alternative circuit arrangements may be possible to produce the sound when such a transistor is maintained on.

Figure 11:
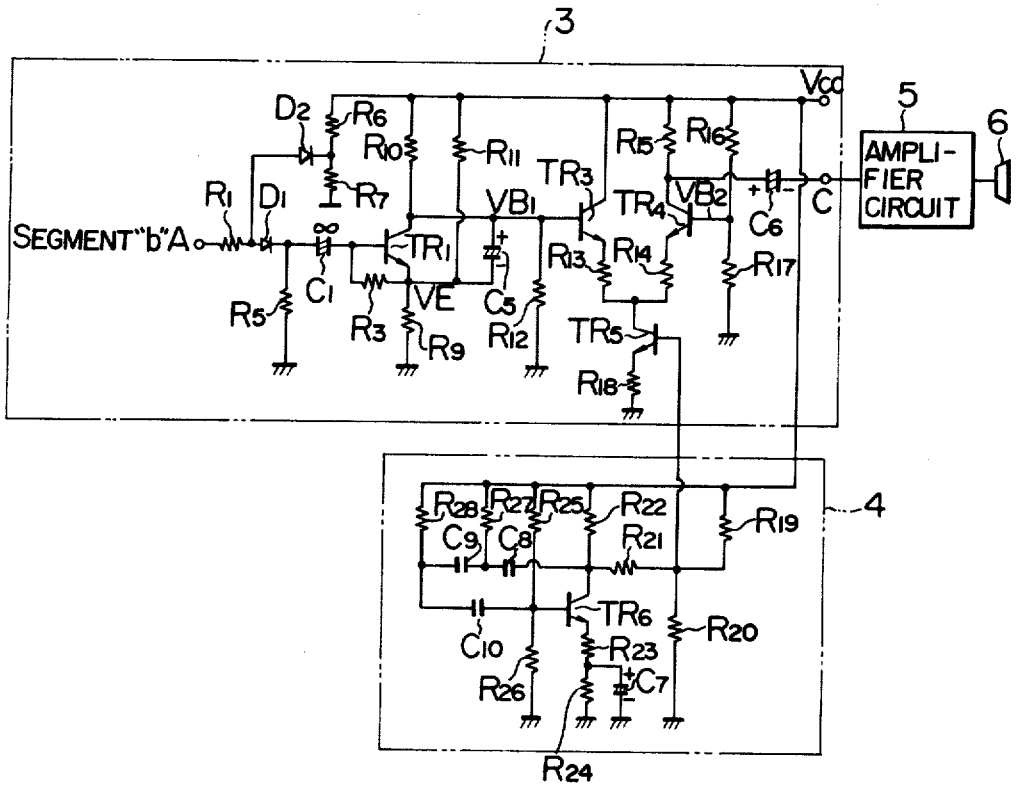
FIG. 11 shows a schematic diagram of another time detection circuit and time sound generator.

FIG. 11 shows another embodiment, in which both a time detection circuit 3 and an oscillator circuit 4 are shown. A differential amplifier is used in place of the transistor $TR_2$ of the time detection circuit of FIG. 3, while a CR oscillator circuit is used for the oscillator 4.

In this figure, the functions of resistors $R_1$, $R_5$, $R_6$ and $R_7$, diodes $D_1$ and $D_2$, a condenser $C_1$ and a transistor $TR_1$ are the same as those of like elements in FIGS. 9 and 10. $R_9$ and $R_{11}$ denote bias resistors which make a condenser $C_5$ discharge rapidly when the transistor $TR_1$ is turned on and fixes the base potential $V_{B1}$ of a transistor $TR_3$ at a constant value ($V_{N1(MIN)}=V_E+V_{CE(SAT)}$ $TR_1$, where $V_{CE(SAT)}$ $TR_1$ is the collector-emitter voltage of the transistor $TR_1$ when $TR_1$ is on). If a relation $V_{B1(MIN)} << V_{B2}$ is satisfied, a time sound with a maximum amplitude appears at a terminal C, where $V_{B2}$ denotes the base (reference) voltage of a transistor $TR_4$ which constitutes a differential amplifier.

After a lapse of time determined by the time constant of the differentiation circuit just after the voltage of the input terminal A changes from a low to a high level, the transistor $TR_1$ is turned off and the condenser $C_5$ is charged gradually through a resistor $R_{10}$. In accordance with this, the base voltage $V_{B1}$ of a transistor $TR_3$ increases and approaches the potential $V_{B2}$. Through differential operation of the transistors $TR_3$ and $TR_4$, the potential $V_{B1}$ rises, whereby the time sound signal from the terminal C diminishes gradually.

When $V_{B1} >> V_{B2}$, the transistor $TR_4$ is cut off and the time sound output from the terminal C is zero. $R_{12}$ is a resistor which suppresses the maximum voltage $V_{B1(MAX)}$ and hence a voltage applied on the condenser $C_5$ while reducing the reverse voltage applied between the base and the emitter of the transistor $TR_4$. $R_{13}$ and $R_{14}$ are emitter resistors of the differential amplifier which extend the dynamic range of the amplifier. $R_{15}$ is a load resistor of the transistor $TR_4$. $R_{16}$ and $R_{17}$ are base bias resistors of the transistor $TR_4$. $TR_5$ denotes a constant current cource transistor, to the base of which a signal from a time sound oscillator circuit 4 is supplied. The signal is amplified by the differential amplifier and modulated by the voltage $V_{B1}$, and an output signal is obtained from the collector of the transistor $TR_4$. $R_{18}$ is an emitter resistor of the constant current transistor $TR_5$ and $C_6$ is a condenser for cutting the d.c. current. In the oscillator circuit 4, $TR_6$ is a transistor for generating a time sound signal. Oscillation having a sinusoidal waveform is obtained at a frequency determined by a phase shift circuit formed by resistors $R_{27}$ and $R_{28}$ and condensers $C_8$, $C_9$ and $C_{10}$. $R_{22}$ is a load resistor. $R_{25}$ and $R_{26}$ are base bias resistors. $R_{23}$ is an emitter resistor for current feedback. $R_{24}$ is an emitter resistor and $C_7$ is a bypass condenser. $R_{19}$, $R_{20}$ and $R_{21}$ are bias resistors for the constant current transistor $TR_5$.

As described above, according to this invention, an error action of a time sound generator circuit is avoided by a very simple method, and a time sound generating circuit with a reliable operation can be obtained.

(A specific value of each element in FIG. 11 is shown below for reference.)

| | | | | | |
|---|---|---|---|---|---|
| $R_1$ | 6.8K | $R_{17}$ | 4.7K | $D_2$ | MA150 |

-continued

| | | | | | |
|---|---|---|---|---|---|
| $R_3$ | 5.6K | $R_{18}$ | 1K | $C_1$ | 4.7μ 16V |
| $R_5$ | 18M | $R_{19}$ | 33K | $C_5$ | 4.7μ 16V |
| $R_6$ | 1K | $R_{20}$ | 2.2K | $C_6$ | 10μ 25V |
| $R_7$ | 390 | $R_{21}$ | 33K | $C_7$ | 47μ 10V |
| $R_9$ | 1K | $R_{22}$ | 6.8K | $C_8$ | 0.0047μ 50V |
| $R_{10}$ | 470K | $R_{23}$ | 27 | $C_9$ | 0.0047μ 50V |
| $R_{11}$ | 3.9K | $R_{24}$ | 1K | $C_{10}$ | 0.0047μ 50V |
| $R_{12}$ | 270K | $R_{25}$ | 120K | $TR_1$ | C1685 |
| $R_{13}$ | 100 | $R_{26}$ | 15K | $TR_3$ | C1685 |
| $R_{14}$ | 100 | $R_{27}$ | 15K | $TR_4$ | C1685 |
| $R_{15}$ | 5.6K | $R_{28}$ | 15K | $TR_5$ | C1685 |
| $R_{16}$ | 15K | $D_1$ | MA150 | $TR_6$ | C1685 |

What we claim is:

1. A time sound generating device comprising:

a time display element having a display portion for a 10-minute digit having seven display segments, one segment of said seven segments being at a high-level light on state during display of the numbers "0" to "4" and at a low-level light off state during display of the number "5";

a time signal generating device for dividing a reference frequency supplied from a reference frequency source and generating a time display driving signal from a resulting frequency-divided output signal to drive said time display element;

a first differentiation time constant circuit connected to said one segment for detecting a change of time by detecting a change in state of the display element driving signal applied to said one segment and for generating a pulse of a predetermined duration upon detection of said change in state;

a switch circuit which changes on-off states in response to said pulse;

a second time constant circuit responsive to said switch circuit changing to a particular on-off state for generating a gradually changing output signal;

an audio frequency signal generating circuit for generating an audio signal;

a gain control circuit having an input terminal receiving said audio signal and an ouput terminal, said gain control circuit changing the amplitude of the audio signal applied to said input terminal and producing the amplitude changed signal from said output terminal in response to the output signal of said second time constant circuit; and loudspeaker means connected to receive the amplitude changed signal from said output terminal.

2. A time sound generating device according to claim 1, wherein said first time constant circuit comprises a series circuit of a differentiation circuit and a unidirectional element.

3. A time sound generating device according to claim 1, further comprising a clamp circuit comprising a switching element and a voltage supply connected in parallel with said first time constant circuit for maintaining the level of the display element driving signal applied to said first time constant circuit below a predetermined level.

4. A time sound generating device according to claim 3, wherein said first time constant circuit comprises a series circuit of a differentiation circuit and a unidirectional element.

5. A time sound generating device comprising:

a time display element having a display portion for a 1-hour digit having seven segments, two segments among said seven segments of said 1-hour digit being related in that a potential level of at least one of said two segments changes when the display number changes at the 1-hour digit;

a time signal generating device for dividing a reference frequency supplied from a reference frequency source and generating a time display driving signal from a resulting frequency-divided output signal to drive said time display element;

a first differentiation time constant circuit connected to said two segments for detecting a change of time by detecting changes in the state of the display element driving signals applied to said two segments and for generating a pulse of a predetermined duration upon detecting said change in state;

a switch circuit which changes on-off states in response to said pulse;

a second time constant circuit responsive to said switch circuit changing to a particular on-off state for generating a gradually changing output signal;

an audio frequency signal generating circuit for generating an audio signal;

a gain control circuit having an input terminal receiving said audio signal and an output terminal, said gain control circuit changing the amplitude of the audio signal applied to said input terminal and producing the amplitude changed signal from said output terminal in response to the output signal of said second time constant circuit; and loudspeaker means connected to receive the amplitude changed signal from said output terminal.

6. A time sound generating device comprising:

a time display element;

a time signal generating device for dividing a reference frequency supplied from a reference frequency source and generating a time display driving signal from a resulting frequency-divided output signal to drive said time display element;

a first time constant circuit connected to part of said time display element for detecting a change of time by detecting a change in state of the time display driving signal and for generating a pulse of a predetermined duration upon detection of said change in state;

a switch circuit which changes on-off states in response to said pulse;

a second time constant circuit responsive to said switch circuit changing to a particular on-off state for generating a gradually changing output signal;

an audio frequency signal generating circuit for generating an audio signal;

a gain control circuit having an input terminal receiving said audio signal and an output terminal, said gain control circuit changing the amplitude of the audio signal applied to said input terminal and producing the amplitude changed signal from said output terminal in response to the output signal of said second time constant circuit, said gain control circuit comprising a first transistor having a base connected to said second time constant circuit, a second transistor having an emitter connected in common with an emitter of said first transistor and a base to which a reference voltage is applied to form a differential amplifier circuit, and a constant current source transistor connected in the emitter circuit of said differential amplifier, said audio signal being connected to a base of said constant current source transistor, an output signal being obtained from a collector of said second transistor; and loudspeaker means connected to receive the amplitude changed signal from said output terminal.

7. A time sound generating device comprising:

a time display element;

a time signal generating device for dividing a reference frequency supplied from a reference frequency source and generating a time display driving signal from a resulting frequency-divided output signal to drive said time display element;

a first time constant circuit connected to part of said time display element for detecting a change of the time display driving signal from a first state to a second state and for generating a pulse of a predetermined duration upon detection of said change in state, said first time constant circuit comprising a series circuit of a differentiation circuit and a unidirectional element which cooperate to prevent said pulse from being generated if said time display driving signal does not remain in said first state for a predetermined period of time before changing to said second state;

a switch circuit which changes on-off states in response to said pulse;

a second time constant circuit responsive to said switch circuit changing to a particular on-off state for generating a gradually changing output signal;

an audio frequency signal generating circuit for generating an audio signal;

a gain control circuit having an input terminal receiving said audio signal and an output terminal, said gain control circuit changing the amplitude of the audio signal applied to said input terminal and producing the amplitude changed signal from said output terminal in response to the output signal of said second time constant circuit; and loudspeaker means connected to receive the amplitude changed signal from said output terminal.

8. A time sound generating device comprising:

a time display element;

a time signal generating device for dividing a reference frequency supplied from a reference frequency source and generating a time display driving signal from a resulting frequency-divided output signal to drive said time display element;

a first time constnat circuit connected to part of said time display element for detecting a change of time by detecting a change in state of the time display driving signal and for generating a pulse of a predetermined duration upon detecting said change in state;

a clamp circuit comprising a switching element and a voltage supply connected in parallel with said first time constant circuit for maintaining the level of the display element driving signals applied to said first time constant circuit below a predetermined level such that fluctuation in the voltage of said driving signal when in a particular state does not cause said first time constant circuit to detect said fluctuation as a change in state of said time display driving signal;

a switch circuit which changes on-off states in response to said pulse;

a second time constant circuit responsive to said switch circuit changing to a particular on-off state for generating a gradually changing output signal;

an audio frequency signal generating circuit for generating an audio signal;

a gain control circuit having an input terminal receiving said audio signal and an output terminal, said gain control circuit changing the amplitude of the audio signal applied to said input terminal and producing the amplitude changed signal from said output terminal in response to the output signal of said second time constant circuit; and loudspeaker means connected to receive the amplitude changed signal from said output terminal.

* * * * *